US007845963B2

(12) United States Patent
Gastineau

(10) Patent No.: US 7,845,963 B2
(45) Date of Patent: Dec. 7, 2010

(54) AXIAL ANTI-ROTATION COUPLING

(75) Inventor: Douglas Reid Gastineau, Costa Mesa, CA (US)

(73) Assignee: ITT Manufacturing Enterprises, Inc., Wilimington, DE (US)

( * ) Notice: Subject to any disclaimer, the term of this patent is extended or adjusted under 35 U.S.C. 154(b) by 137 days.

(21) Appl. No.: 12/288,505

(22) Filed: Oct. 21, 2008

(65) Prior Publication Data

US 2010/0099290 A1 Apr. 22, 2010

(51) Int. Cl.
*H01R 4/38* (2006.01)

(52) U.S. Cl. ..... 439/321

(58) Field of Classification Search ..... 439/317–321, 439/310, 312

See application file for complete search history.

(56) References Cited

U.S. PATENT DOCUMENTS 3,917,373 A * 11/1975 Peterson ..... 439/321
4,007,953 A * 2/1977 Powell ..... 285/321
4,508,408 A * 4/1985 Shepler et al. ..... 439/313
4,703,988 A * 11/1987 Raux et al. ..... 439/321
5,145,394 A 9/1992 Hager
5,435,760 A 7/1995 Miklos
5,653,605 A 8/1997 Woehl et al.
5,957,716 A 9/1999 Buckley et al.
6,123,563 A 9/2000 Johnson et al.
6,152,753 A 11/2000 Johnson et al.
7,032,931 B2 4/2006 Austin
7,625,226 B1 * 12/2009 Gastineau ..... 439/321
2009/0297256 A1 * 12/2009 Gross, III ..... 403/105

* cited by examiner

*Primary Examiner*—Xuong M Chung Trans
(74) *Attorney, Agent, or Firm*—Peter Van Winkle

(57) ABSTRACT

A mechanism of low cost and easy mounting, provides resistance to rotation of a coupling nut (14) of an electrical connector about the barrel (12) of the connector, and provides a higher resistance to rotation in one direction (U) than the opposite direction (M). A toothed ring (44) with a circle of teeth, is fixed to the barrel. The mechanism includes a washer (42) with projections (70, 72) that engage the teeth of the ring to ride over them during nut rotation, and thereby provide resistance to nut rotation. The washer is bent to form a spring to bias its projections against the teeth of the toothed ring. The washer also has ears (75, 76) that fit into slots in the nut to prevent washer rotation relative to the nut. The teeth of the toothed ring have first sides that are steeper than its second sides to provide higher resistance to rotation in one direction.

11 Claims, 2 Drawing Sheets

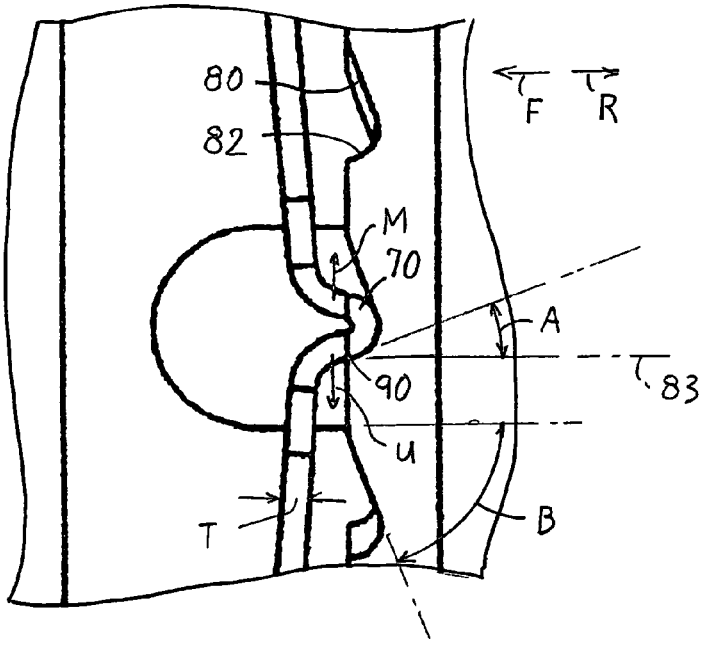
FIG. 3
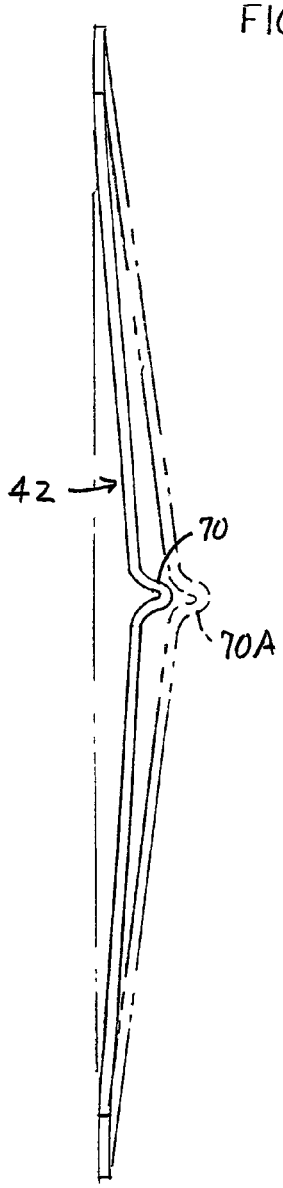
FIG. 5
FIG. 4
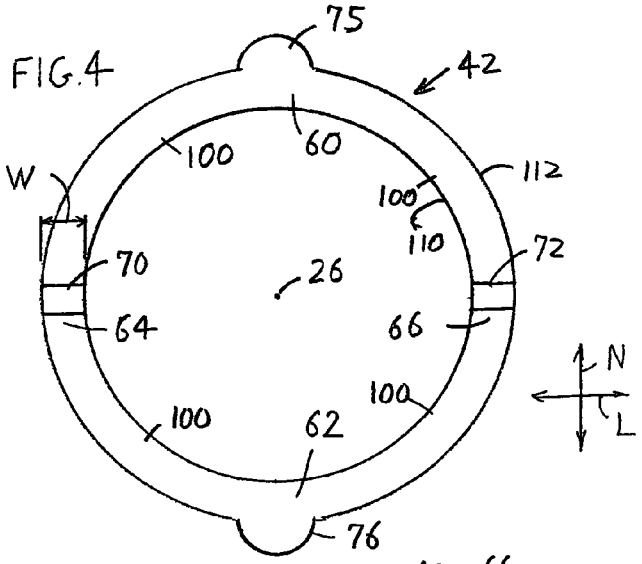
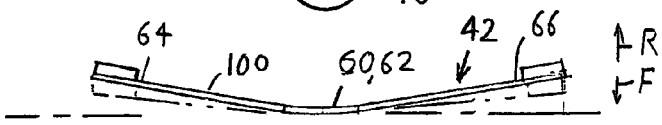
FIG. 6

AXIAL ANTI-ROTATION COUPLING

BACKGROUND OF THE INVENTION

One type of electrical connector includes a barrel on which is mounted an insulative body with passages that hold wires and contacts. A coupling nut is rotatably mounted on the barrel so the nut can be rotated to thread it onto a mating second connector that has mating contacts. It is usually desirable to allow nut rotation with only a moderate resistance in a first direction to move the connectors together to mate, and to provide a much higher resistance to nut rotation in the opposite second direction to move the connectors apart to unmate. One type of mechanism includes a ring with projections for engaging a ring of teeth on the barrel, and a wave spring that biases the ring and its projections against the teeth. Pins extending thorough the ring prevent its rotation relative to the barrel. The need for two or three different parts that each must be mounted, adds to the complexity and cost of the connector.

SUMMARY OF THE INVENTION

In accordance with one embodiment of the invention, an electrical connector is provided which has a coupling nut rotatable about a barrel, around a connector axis that extends in forward and rearward directions. The connector also has a simple and low cost mechanism for regulating resistance to nut rotation. The mechanism provides low resistance to nut rotation in a first direction for mating to another connector, and provides a higher resistance to nut rotation in an opposite second direction for unmating.

The barrel has a circle of teeth. The mechanism includes a control washer that is bent to form a spring, with opposite front locations resting against a forward-facing surface on the nut, and with opposite rear locations biased against the circle of teeth. The teeth of the circle of teeth have opposite teeth sides that are inclined by different amounts to the forward direction to provide different resistances to nut rotation.

The control washer rear locations are bent into loops that form rearward projections that press against the circle of teeth. The washer has ears that extend radially outward into slots formed in the nut, to prevent rotation of the washer. The control washer replaces the plurality of parts previously used, to reduce cost of manufacture and cost of installation.

The novel features of the invention are set forth with particularity in the appended claims. The invention will be best understood from the following description when read in conjunction with the accompanying drawings.

BRIEF DESCRIPTION OF THE DRAWINGS

FIG. 3 is a greatly enlarged view of a portion of FIG. 2.

FIG. 4 is a rear elevation view of the control washer of FIG. 2.

FIG. 5 is a side elevation view of the control washer of FIG. 4, showing the washer in its undeflected position in phantom lines, and in its deflected position in solid lines.

FIG. 6 is bottom view of the washer of FIG. 4.

DESCRIPTION OF THE INVENTION

Figure 1:
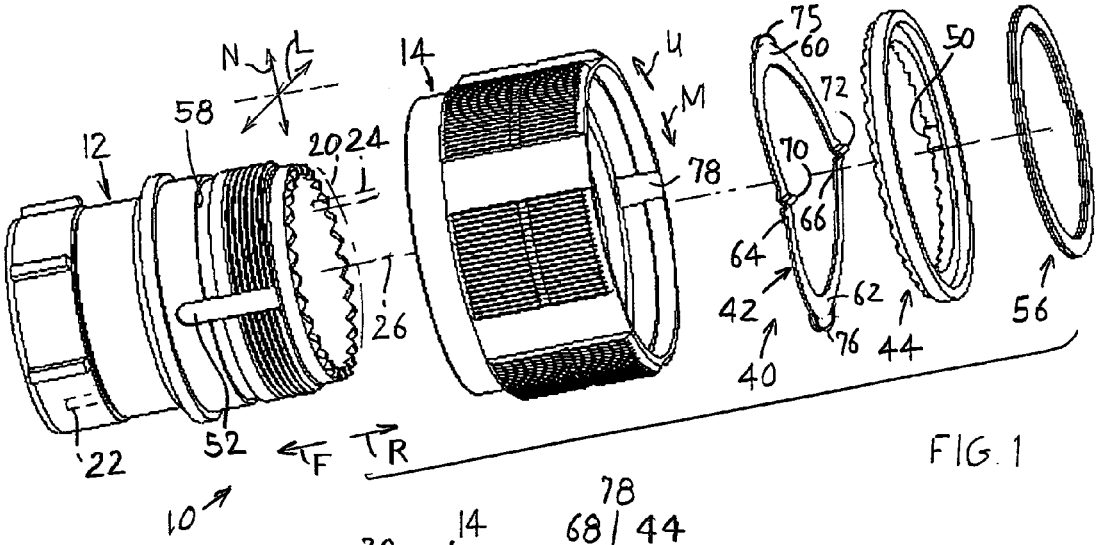
FIG. 1 is an exploded isometric view of a connector of the present invention.
Figure 2:
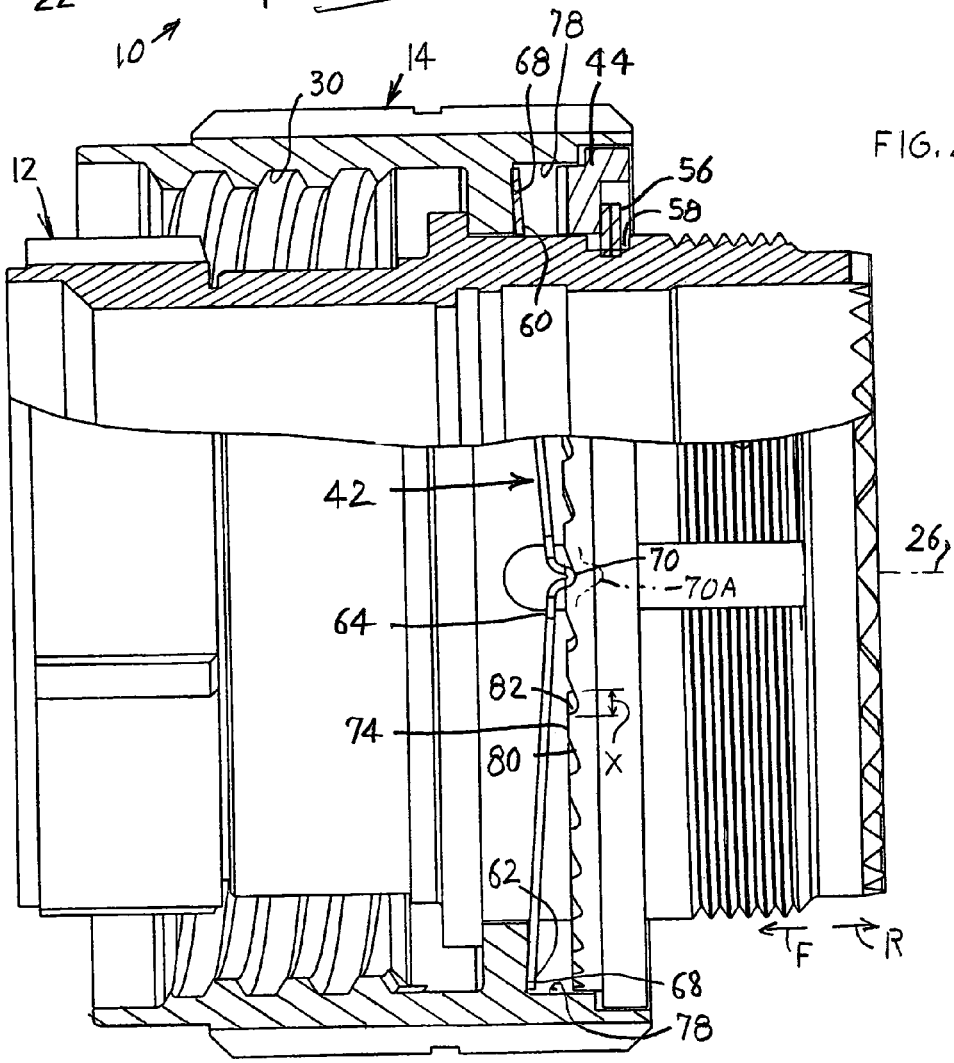
FIG. 2 is a sectional view of the assembled connector of FIG. 1.

FIGS. 1 and 2 show an electrical connector 10 of the present invention which includes a barrel element 12 and a coupling nut element 14. The barrel 12 is used to mount a dielectric body 20 that holds contacts 22 and wires 24. The connector has a connector axis 26. The nut 14 is rotatable by hand about the barrel, and the nut has internal threads 30 that receive a threaded mating connector (not shown) to mate thereto. During mating, the nut 14 is turned in a mating direction M to advance the connector 10 in a mating, or forward F direction, and during unmating the nut is turned in the unmating direction U to move the connector in the unmating, or rear direction R.

It is desirable to provide moderate resistance to turning of the coupling nut during mating. However, it is desirable to provide a much higher resistance to turning of the nut during unmating to prevent unintentional nut turning and corresponding unintentional unmating of the connectors. The connector includes a mechanism 40 for accomplishing this. The mechanism includes a control washer 42, formed by an initially flat thin ring, that is centered on the axis 26 and that controls resistance to turning of the nut. A toothed ring 44 is mounted to rotate with the barrel, while allowing the toothed wheel to slide parallel to the axis. The toothed ring 44 has a pair of axially-extending grooves 50 that receive axially-extending projections 52 on the barrel. The projections 52 lock the toothed ring against rotation relative to the barrel, while allowing the toothed ring to slide forward and rearward which facilitates assembly and disassembly. A common snap ring 56 that snaps into a groove 58 on the outside of the barrel, holds the tooth ring on the barrel.

The control washer has a top and bottom (as seen in FIGS. 1 and 2) forming longitudinally N spaced front resting locations 60, 62 and the washer has laterally L spaced opposite rear sides 64, 66. The resting locations rest on portions of a rearward-facing washer-support surface 68 of the coupling nut that lie a distance forward of the toothed ring and that face the toothed ring. The washer is bent, with the opposite rear sides 64, 66 lying a distance rearward R of the front resting locations 60, 62. The rear sides 64, 66 have rearward projections or bumps 70, 72 that project rearward and engage the teeth of the toothed ring 44. The projections are circumferentially spaced (about axis 26), as are the rear sides. The washer also has radially-projecting ears 75, 76 that project into slots or notches 78 in the coupling nut to prevent relative rotation of the washer in the nut.

FIG. 2 shows the control washer after it has been installed, showing that the teeth 74 of the toothed ring have teeth sides 80, 82 that are circumferentially (with respect to axis 26) spaced. One side 80 of each tooth extends at a large incline to the axial direction (direction of axis 26) and the other side 82 extends at a much smaller incline. The washer projections such as 70 initially lie at position 70A, but are pushed forward F to position 70 when the toothed ring 44 and snap ring 56 are installed. As a result, the control washer serves as a spring that biases its projections against the toothed ring 44 which, in turn, is biased against the snap ring 56.

Each of the washer projection 70, 72 (FIG. 4) are formed by bending a washer location in a half circle with transitions to form a projecting loop. The loop preferably extends across the radial width W of the ring that forms the washer. The washer width W is a plurality of times its thickness T. The teeth of the toothed wheel have a constant shape across their radial width (X, FIG. 2). As a result, there tends to be area contact (rather than point contact) of each projection 70, 72 with the teeth of the toothed ring. It is possible to provide projections by welding on projections or by pressing out locations on the washer to form projections.

FIG. 3 shows that the top, or front end, of the steep side 82 of each tooth extends at an angle A of about 20° to a line 83 that is parallel to the axis. The projection 70 has a location 90 that engages the top of the steep side and that also extends at an angle A of about 20° to the axial direction. The shallow side 80 of each tooth extends at an angle B of about 70° to the axial direction. It takes much less force to move the projection 70 in the mating direction M than the unmating direction. The angle A is preferably no more than 30° while the angle B is preferably at least 30°.

FIG. 4 shows that the control washer 42 has primarily circular inner and outer edges 110, 112, and has a pair of radially outwardly extending ears 75, 76 at the rear resting location 60, 62 (and that are part of the resting locations). The inner edge 110 forms a primarily circular hole centered on the axis 26. FIG. 2 shows that the coupling nut has a pair of slots 78 that receive the ears, to prevent relative rotation of the control washer with respect to the nut 14. FIG. 6 shows that in a top or bottom view of the control washer 42, it can be seen that the washer is bent to place its opposite sides 64, 66 rearward of the top and bottom ends 60, 62, with inclined intermediate washer parts 100 connecting the sides and ends.

Thus, the control washer serves several purposes in a single element that can be made at low cost and that is easily installed. First, the washer forms projections that engage the toothed wheel to control resistance to coupling nut rotation in each turning direction M, U. Second, the washer serves as a spring that not only biases its projections into contact with the tooth wheel, but that biases the toothed wheel 44 against the snap ring 46, thereby eliminating the need for a separate spring washer or other biasing device. Third, the ears 75, 76 on the top and bottom of the washer fit into simple slots 78 in the nut to prevent rotation. The use of a single washer reduces the likelihood of failure of one of a few separate parts, while making installation easy and reducing cost.

Thus, the invention provides an electrical connector with a coupling nut that rotates about a barrel, which controls resistance to rotation in each direction in a simple mechanism. While the invention was developed for use with an electrical connector, it can be used for optical connectors, which are the equivalent. The washer is preferably formed from a bent piece of sheet metal that has a spring temper, although it possible to form it of plastic or other material. Although the washer is shown as having two opposite sides 64, 66 and two opposite ends 60, 62, it is possible to have three 120°-spaced sides and three 120°-spaced ends. It would be possible to use a first washer with projections for engaging the teeth of the toothed wheel and with projecting ears to prevent its rotation, and to use a separate second washer that is bent to form a spring that biases the first washer rearward, although this is not preferred.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector that includes a barrel (12) for holding a contact-mounting body (20), a coupling nut (14) extending around said barrel and rotatable on said barrel about an axis (26), and a mechanism (40) coupled to said barrel and nut that resists rotation of the nut in at least a first direction of rotation about said axis, said mechanism includes a washer (42) that is fixed against rotation relative to said nut (14) and a toothed ring (44) that is fixed against rotation relative to said barrel (12), wherein:

said nut has a plurality of washer-support surface portions (68);

said washer comprises an initially flat ring that is bent to form a plurality of circumferentially-spaced resting locations (60, 62, FIG. 2) that rest against said washer-support surface portions (68), and said washer has a plurality of sides (64, 66) that each forms a rearward projection (70, 72) that each projects rearward (R) from a corresponding one of said sides;

said washer being bent so said sides (64, 66) lie rearward (R) of said front resting locations (60, 62), whereby the washer provides projections that lie against said toothed ring and also provides a spring force that presses the projections of the washer against the toothed ring.

2. The connector described in claim 1 wherein:

said nut has a pair of slots (78) with a rear-facing wall of each slot forming one of said washer-support surfaces (68), and said washer has a pair of ears (75, 76) each lying in one of said slots and against one of said washer-support surfaces.

3. The connector described in claim 1 wherein:

said sides (64, 66) of said washer have bends that form rearward-projecting bumps (70, 72) with rounded rear ends that form said projections.

4. The connector described in claim 1 wherein:

said teeth ring (44) is axially slidable on said barrel but is not rotatable about said axis relative to said barrel.

5. A connector that comprises elements including a barrel (12) for holding a contact-mounting body and a coupling nut (14) extending around and rotatable about an axis (26) on the barrel, said connector including a teeth ring (44) held against rotation relative to a first of said elements and a mechanism (40) that engages said teeth ring and the second of said elements to resist coupling nut rotation, wherein:

said mechanism includes a washer (42) that is initially formed of a thin ring and that has a washer hole lying on said axis, said washer having a plurality of bends at each of a plurality of locations (64, 66) that are angularly spaced about said axis to form resting locations (60, 62) that rest against said nut to orient said washer, and said washer having sides (64, 66) that lie rearward (R) of said resting locations and that form projections (70, 72) at said sides with said proiections projecting axially rearward into engagement with teeth of said teeth ring.

6. The connector described in claim 5 wherein:

said bends that form said projections each forms a loop that extends in a half circle.

7. The connector described in claim 5, wherein:

said nut forms a pair of rearward-facing support surface portions (68);

said resting locations (60, 62) of said washer are longitudinally-spaced (N) to lie on opposite sides of said axis, and said projections (70, 72) lie on laterally (L) opposite sides of said axis, with said longitudinal and lateral directions (N, L) being perpendicular to each other.

8. Apparatus having barrel and nut elements of a connector to allow the nut element to turn relative to the barrel element about a connector axis (26) that extends in front (F) and rear (R) directions while resisting such turning, wherein said apparatus includes a ring (44) of forward-projecting teeth with the ring being rotatably fixed to a first of said elements (12) and the second element (14) has a plurality of support surfaces (68) that face rearward, wherein:

said apparatus comprises a washer (42) in the form of a thin circular band with a primarily circular hole and with a washer axis lying on said connector axis, said washer being bent to form a plurality of angularly spaced washer front end parts (75, 76) resting on said support surfaces (68), a plurality of angularly-spaced washer rear ends (64, 66) lying rearward of said washer front end parts, and a plurality of inclined intermediate washer parts (100) that each extends between one of said rear end parts and one of said front end parts, said washer rear end parts (64, 66) each has a bend that forms a rearward projection (70, 72) for engaging said teeth.

9. The apparatus described in claim 8 wherein:

said bends that form rearward projections are primarily in the form of half circles that extend across the entire radial width (W) of said washer.

10. The apparatus described in claim 8 wherein:

said second element has a pair of slots (78) with slot walls that form said support surfaces (68), and said washer has a pair of radially outwardly projecting ears (75, 76) that fit into said slots and lie against said support surfaces.

11. The apparatus described in claim 8 wherein:

said ring of teeth is rotatable in opposite directions about said axis relative to said first element.

* * * * *